US006105219A

United States Patent [19]

Beadle

[11] Patent Number: 6,105,219

[45] Date of Patent: Aug. 22, 2000

[54] BUCKLE GUARD

[76] Inventor: Rebecca B. Beadle, 101 Southwest Rd., Lot 2, Morgan City, La. 70380

[21] Appl. No.: 09/337,683

[22] Filed: Jun. 22, 1999

[51] Int. Cl.[7] ..... A44B 11/00

[52] U.S. Cl. ..... 24/633; 24/573.1

[58] Field of Search ..... 24/633, 634, 573.1, 24/487, 500, 318

[56] References Cited

U.S. PATENT DOCUMENTS

| | | | |
|---|---|---|---|
| 4,046,296 | 9/1977 | McGhee | 224/26 D |
| 4,674,303 | 6/1987 | Salcone, II | 70/63 |
| 4,675,954 | 6/1987 | Gullickson | 24/633 |
| 4,731,912 | 3/1988 | Boriskie et al. | 24/633 |
| 4,878,277 | 11/1989 | Portuese | 24/573.1 |
| 4,901,407 | 2/1990 | Pandola et al. | 24/633 |
| 4,939,824 | 7/1990 | Reed | 24/633 |
| 4,961,251 | 10/1990 | Smith | 24/633 |
| 4,987,662 | 1/1991 | Haffey et al. | 24/633 |
| 5,129,129 | 7/1992 | Collins et al. | 24/633 |
| 5,189,767 | 3/1993 | Reitsma | 24/633 |
| 5,307,544 | 5/1994 | Quarberg et al. | 24/633 |
| 5,442,840 | 8/1995 | Ewald | 24/633 |
| 5,548,878 | 8/1996 | Romagnoli | 24/633 |
| 5,617,617 | 4/1997 | Gustin | 24/633 |
| 5,620,231 | 4/1997 | Marker et al. | 297/250.1 |
| 5,716,388 | 2/1998 | Petelle | 607/108 |

*Primary Examiner*—Victor N. Sakran
*Attorney, Agent, or Firm*—Joseph N. Breaux

[57] ABSTRACT

A buckle guard that is positionable over and around the buckle assembly of a vehicle seat belt shoulder harness to prevent a child from accessing and disconnecting the buckle assembly. The buckle guard includes a back guard section, an inner snap guard section and an outer snap guard section. The back guard section is integrally formed between the inner snap guard section and the outer snap guard section. The back guard section, the inner snap guard section and the outer snap guard section being constructed of a bendable plastic.

1 Claim, 2 Drawing Sheets

FIG.3
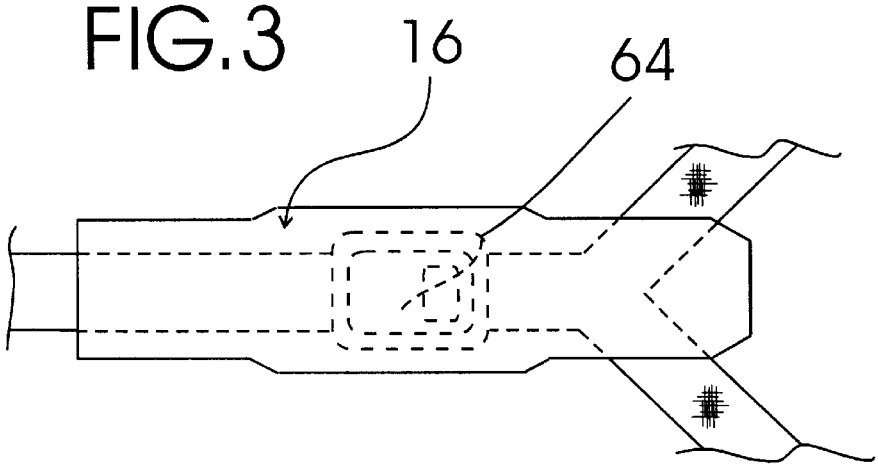
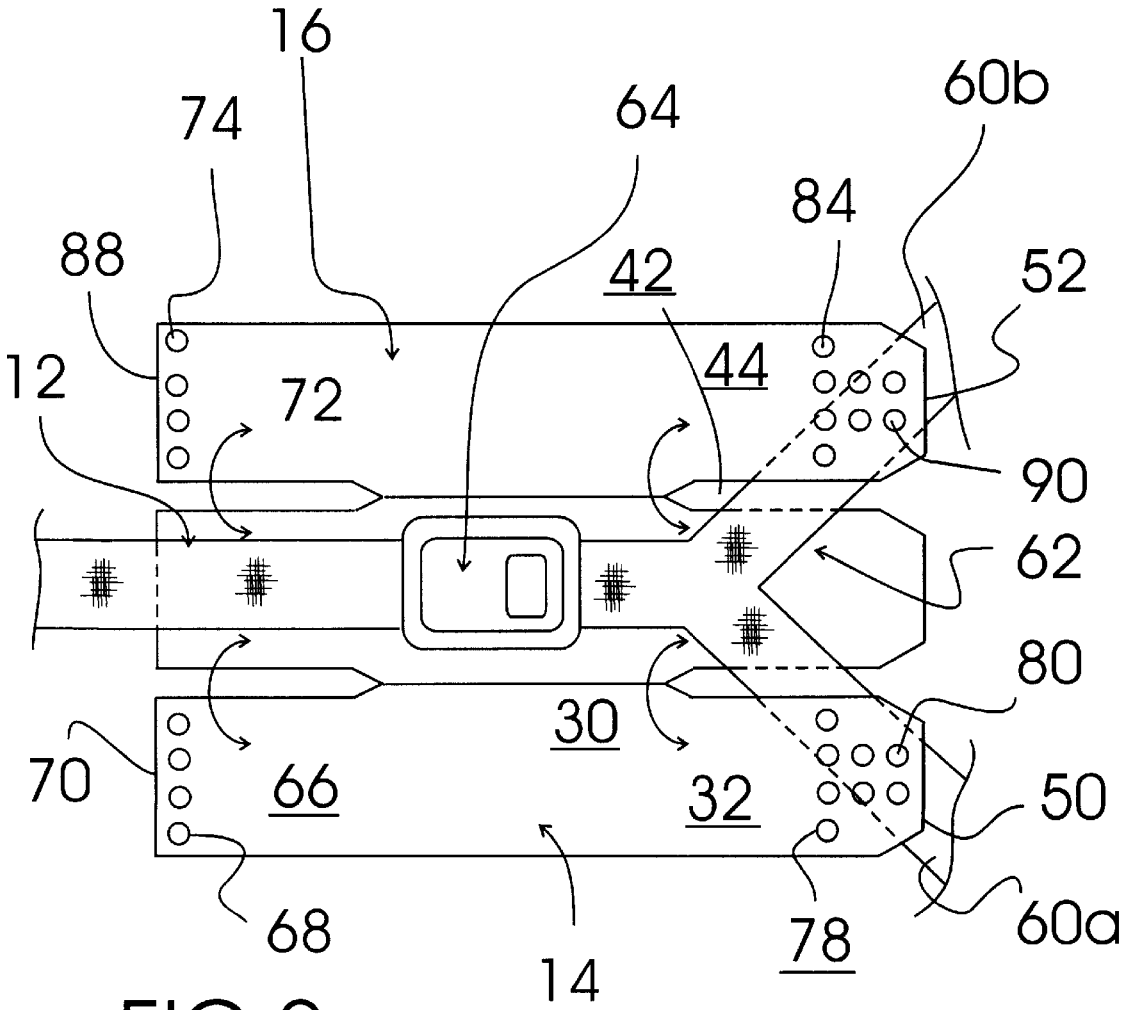
FIG.2

BUCKLE GUARD

TECHNICAL FIELD

The present invention relates to guards for the buckle assembly of a vehicle seat belt and shoulder harness assembly and more particularly to a buckle guard that includes a back guard section integrally formed between an inner snap guard section and an outer snap guard section; the back guard section, the inner snap guard section and the outer snap guard section being constructed of a bendable plastic; the back guard section being bendably connected to the inner snap guard section and the outer snap guard section by two bendable back guard connection portions positioned midway between back guard section front and back end edges and extending out on opposite side edges thereof; one bendable back guard connection portion being in connection with a bendable inner snap guard connection portion extending outward from a mid section of the inner snap guard section such that a first insertion slot is formed between a front portion of the inner guard section and a first side edge of a front portion of the back guard section; the other bendable back guard connection portion being in connection with a bendable outer snap guard connection portion extending outward from a mid section of the outer snap guard section such that a second insertion slot is formed between the front portion of the outer guard section and a second side edge of a front portion of the back guard section; the corner ends of an inner snap guard section front end edge, an outer snap guard section front end edge, and the back guard section front end edge being beveled to create a first enlarged strap insertion guide at an entrance of the first insertion slot and a second enlarged strap insertion guide at an entrance of the second insertion slot to aid in inserting the straps of the seat belt and shoulder harness during installation of the buckle guard; an inner guard section back end portion having a number of spaced back end portion snap end receiving apertures formed therethrough in parallel orientation with an inner guard section back edge; an outer guard section back end portion having a number of spaced back end portion snap ends extending outwardly therefrom sized and spaced to simultaneously snap fit into the number of back end portion snap end receiving apertures of the inner guard section; the inner guard section front end portion having a number of spaced front end portion snap end receiving apertures formed therethrough in parallel orientation with the inner guard section back edge and four tip end snap end receiving apertures formed therethrough in a square shaped configuration positioned between the spaced front end portion snap end receiving apertures and the inner guard section front end edge; the outer guard section front end portion having a number of spaced front end portion snap ends extending outwardly therefrom in parallel orientation with the outer guard section back end edge and sized and spaced to simultaneously snap fit into the number of front end portion snap end receiving apertures of the inner guard section and four tip end snap ends extending outwardly therefrom in a square shaped configuration positioned between the spaced front end portion snap ends and the outer guard section front end edge.

BACKGROUND ART

It is typically dangerous for a child to unbuckle the buckle assembly of a seat belt and shoulder harness assembly when the vehicle is moving. It would be a benefit, therefore, to have a buckle guard that could be positioned over and around the buckle assembly to prevent a child from accessing and disconnecting the buckle assembly.

GENERAL SUMMARY DISCUSSION OF INVENTION

It is thus an object of the invention to provide a buckle guard that includes a back guard section integrally formed between an inner snap guard section and an outer snap guard section; the back guard section, the inner snap guard section and the outer snap guard section being constructed of a bendable plastic; the back guard section being bendably connected to the inner snap guard section and the outer snap guard section by two bendable back guard connection portions positioned midway between back guard section front and back end edges and extending out on opposite side edges thereof; one bendable back guard connection portion being in connection with a bendable inner snap guard connection portion extending outward from a mid section of the inner snap guard section such that a first insertion slot is formed between a front portion of the inner guard section and a first side edge of a front portion of the back guard section; the other bendable back guard connection portion being in connection with a bendable outer snap guard connection portion extending outward from a mid section of the outer snap guard section such that a second insertion slot is formed between the front portion of the outer guard section and a second side edge of a front portion of the back guard section; the corner ends of an inner snap guard section front end edge, an outer snap guard section front end edge, and the back guard section front end edge being beveled to create a first enlarged strap insertion guide at an entrance of the first insertion slot and a second enlarged strap insertion guide at an entrance of the second insertion slot to aid in inserting the straps of the seat belt and shoulder harness during installation of the buckle guard; an inner guard section back end portion having a number of spaced back end portion snap end receiving apertures formed therethrough in parallel orientation with an inner guard section back edge; an outer guard section back end portion having a number of spaced back end portion snap ends extending outwardly therefrom sized and spaced to simultaneously snap fit into the number of back end portion snap end receiving apertures of the inner guard section; the inner guard section front end portion having a number of spaced front end portion snap end receiving apertures formed therethrough in parallel orientation with the inner guard section back edge and four tip end snap end receiving apertures formed therethrough in a square shaped configuration positioned between the spaced front end portion snap end receiving apertures and the inner guard section front end edge; the outer guard section front end portion having a number of spaced front end portion snap ends extending outwardly therefrom in parallel orientation with the outer guard section back end edge and sized and spaced to simultaneously snap fit into the number of front end portion snap end receiving apertures of the inner guard section and four tip end snap ends extending outwardly therefrom in a square shaped configuration positioned between the spaced front end portion snap ends and the outer guard section front end edge.

Accordingly, a buckle guard is provided. The buckle guard includes a back guard section integrally formed between an inner snap guard section and an outer snap guard section; the back guard section, the inner snap guard section and the outer snap guard section being constructed of a bendable plastic; the back guard section being bendably connected to the inner snap guard section and the outer snap guard section by two bendable back guard connection portions positioned midway between back guard section front and back end edges and extending out on opposite side edges thereof; one bendable back guard connection portion being in connection with a bendable inner snap guard connection portion extending outward from a mid section of the inner snap guard section such that a first insertion slot is formed between a front portion of the inner guard section and a first side edge of a front portion of the back guard section; the other bendable back guard connection portion being in connection with a bendable outer snap guard connection portion extending outward from a mid section of the outer snap guard section such that a second insertion slot is formed between the front portion of the outer guard section and a second side edge of a front portion of the back guard section; the corner ends of an inner snap guard section front end edge, an outer snap guard section front end edge, and the back guard section front end edge being beveled to create a first enlarged strap insertion guide at an entrance of the first insertion slot and a second enlarged strap insertion guide at an entrance of the second insertion slot to aid in inserting the straps of the seat belt and shoulder harness during installation of the buckle guard; an inner guard section back end portion having a number of spaced back end portion snap end receiving apertures formed therethrough in parallel orientation with an inner guard section back edge; an outer guard section back end portion having a number of spaced back end portion snap ends extending outwardly therefrom sized and spaced to simultaneously snap fit into the number of back end portion snap end receiving apertures of the inner guard section; the inner guard section front end portion having a number of spaced front end portion snap end receiving apertures formed therethrough in parallel orientation with the inner guard section back edge and four tip end snap end receiving apertures formed therethrough in a square shaped configuration positioned between the spaced front end portion snap end receiving apertures and the inner guard section front end edge; the outer guard section front end portion having a number of spaced front end portion snap ends extending outwardly therefrom in parallel orientation with the outer guard section back end edge and sized and spaced to simultaneously snap fit into the number of front end portion snap end receiving apertures of the inner guard section and four tip end snap ends extending outwardly therefrom in a square shaped configuration positioned between the spaced front end portion snap ends and the outer guard section front end edge.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein:

FIG. 2 is a top plan view showing the seat belt and shoulder harness straps positioned, respectively, through the first and second insertion slots and the buckle positioned in the center of the back guard section.

FIG. 3 is a top plan view showing the buckle guard installed around the representative seat belt and shoulder harness buckle assembly with the outer snap guard section snapped onto the inner snap guard section and the seat belt and shoulder harness straps positioned, respectively, through the first and second insertion slots.

EXEMPLARY MODE FOR CARRYING OUT THE INVENTION

Figure 1:
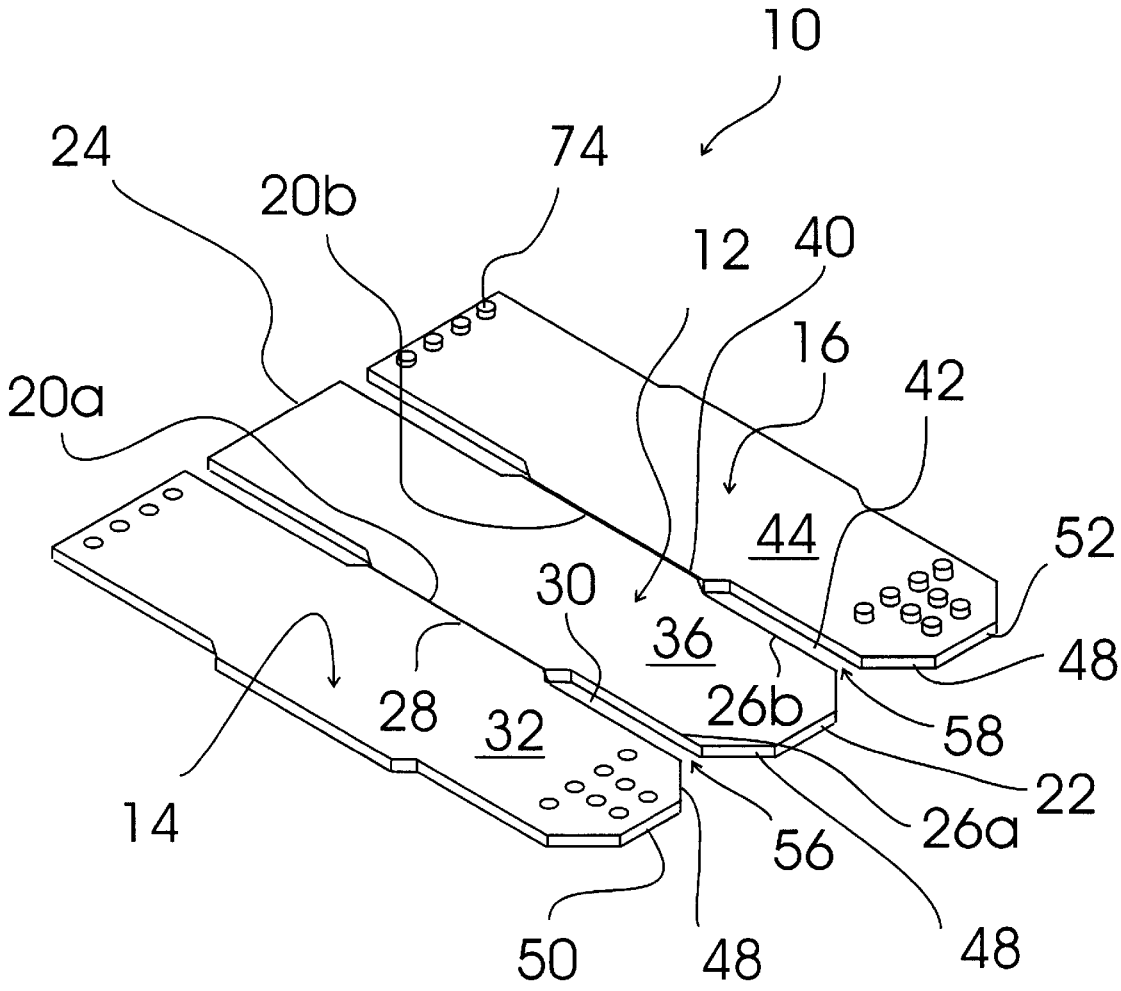
FIG. 1 is a perspective view of an exemplary embodiment of the buckle guard of the present invention showing the back guard section integrally formed between the inner snap guard section and the outer snap guard section; the back guard section being bendably connected to the inner snap guard section and the outer snap guard section by two bendable back guard connection portions positioned midway between back guard section front and back end edges and extending out on opposite side edges thereof; one bendable back guard connection portion being in connection with a bendable inner snap guard connection portion extending outward from a mid section of the inner snap guard section such that a first insertion slot is formed between a front portion of the inner guard section and a first side edge of a front portion of the back guard section; the other bendable back guard connection portion being in connection with a bendable outer snap guard connection portion extending outward from a mid section of the outer snap guard section such that a second insertion slot is formed between the front portion of the outer guard section and a second side edge of a front portion of the back guard section; the corner ends of an inner snap guard section front end edge, an outer snap guard section front end edge, and the back guard section front end edge being beveled to create a first enlarged strap insertion guide at an entrance of the first insertion slot and a second enlarged strap insertion guide at an entrance of the second insertion slot to aid in inserting the straps of the seat belt and shoulder harness during installation of the buckle guard; an inner guard section back end portion having a number of spaced back end portion snap end receiving apertures formed therethrough in parallel orientation with an inner guard section back edge; an outer guard section back end portion having a number of spaced back end portion snap ends extending outwardly therefrom sized and spaced to simultaneously snap fit into the number of back end portion snap end receiving apertures of the inner guard section; the inner guard section front end portion having a number of spaced front end portion snap end receiving apertures formed therethrough in parallel orientation with the inner guard section back edge and four tip end snap end receiving apertures formed therethrough in a square shaped configuration positioned between the spaced front end portion snap end receiving apertures and the inner guard section front end edge; the outer guard section front end portion having a number of spaced front end portion snap ends extending outwardly therefrom in parallel orientation with the outer guard section back end edge and sized and spaced to simultaneously snap fit into the number of front end portion snap end receiving apertures of the inner guard section and four tip end snap ends extending outwardly therefrom in a square shaped configuration positioned between the spaced front end portion snap ends and the outer guard section front end edge.

FIG. 1 shows an exemplary embodiment of the buckle guard of the present invention generally designated 10. Buckle guard 10 includes a back guard section, generally designated 12; an inner snap guard section, generally designated 14; and an outer snap guard section, generally designated 16. Back guard section 12 is integrally formed between inner snap guard section 14 and outer snap guard section 16. Back guard section 12 is bendably connected to inner snap guard section 14 and outer snap guard section 16 by two bendable back guard connection portions **20*a*,20*b* positioned midway between back guard section front and back end edges 22,24 and extending out on opposite side edges 26*a*,26*b* thereof. Bendable back guard connection portion 20*a* is in connection with a bendable inner snap guard connection portion 28 extending outward from a mid section of inner snap guard section 14 such that a first insertion slot 30 is formed between a front portion 32 of inner guard section 14 and side edge 26*a*** of a front portion 36 of back guard section 12. Bendable back guard connection portion 20*b* is in connection with a bendable outer snap guard connection portion 40 extending outward from a mid section of outer snap guard section 16 such that a second insertion slot 42 is formed between front portion 44 of outer guard section 16 and side edge 26*b* of front portion 36 of back guard section 12.

The corner ends 48 of an inner snap guard section front end edge 50, an outer snap guard section front end edge 52, and back guard section front end edge 22 are beveled to create a first enlarged strap insertion guide 56 at an entrance of first insertion slot 30 and a second enlarged strap insertion guide 58 at an entrance of second insertion slot 42 to aid in inserting, with reference now to FIG. 2, the straps 60*a*,60*b* of a seat belt assembly, generally designated 62, having a buckle assembly, generally designated 64.

An inner guard section back end portion 66 has four spaced back end portion snap end receiving apertures 68 formed therethrough in parallel orientation with an inner guard section back edge 70. An outer guard section back end portion 72 has four spaced back end portion snap ends 74 (see also FIG. 1) extending outwardly therefrom sized and spaced to simultaneously snap fit into the four back end portion snap end receiving apertures 68. Inner guard section front end portion 32 has four spaced front end portion snap end receiving apertures 18 formed therethrough in parallel orientation with inner guard section back edge 70 and four tip end snap end receiving apertures 80 formed therethrough in a square shaped configuration positioned between spaced front end portion snap end receiving apertures 78 and inner guard section front end edge 50. Outer guard section front end portion 44 has four spaced front end portion snap ends 84 extending outwardly therefrom in parallel orientation with outer guard section back end portion snap ends 74 and outer guard section back end edge 80 and sized and spaced to simultaneously snap fit into the four front end portion snap end receiving apertures 78 of inner snap guard section 14 and four tip end snap ends 90 extending outwardly therefrom in a square shaped configuration positioned between spaced front end portion snap ends 84 and outer guard section front end edge 52.

Once straps 60*a*,60*b* of seat belt assembly 62 are positioned, respectively, in insertion slots 30,42 and buckle assembly 64 is placed in the center of back guard section 12, inner snap guard section 14 is folded over buckle assembly 64, and referring now to FIG. 3, outer snap guard section 6 is folded over and snap connected to inner snap guard section 14 (FIGS. 1 and 2) to surround buckle assembly 64 (see also FIG. 2) and prevent access thereto by a small child.

It can be seen from the preceding description that a buckle guard has been provided that includes a back guard section integrally formed between an inner snap guard section and an outer snap guard section; the back guard section, the inner snap guard section and the outer snap guard section being constructed of a bendable plastic; the back guard section being bendably connected to the inner snap guard section and the outer snap guard section by two bendable back guard connection portions positioned midway between back guard section front and back end edges and extending out on opposite side edges thereof; one bendable back guard connection portion being in connection with a bendable inner snap guard connection portion extending outward from a mid section of the inner snap guard section such that a first insertion slot is formed between a front portion of the inner guard section and a first side edge of a front portion of the back guard section; the other bendable back guard connection portion being in connection with a bendable outer snap guard connection portion extending outward from a mid section of the outer snap guard section such that a second insertion slot is formed between the front portion of the outer guard section and a second side edge of a front portion of the back guard section; the corner ends of an inner snap guard section front end edge, an outer snap guard section front end edge, and the back guard section front end edge being beveled to create a first enlarged strap insertion guide at an entrance of the first insertion slot and a second enlarged strap insertion guide at an entrance of the second insertion slot to aid in inserting the straps of the seat belt and shoulder harness during installation of the buckle guard; an inner guard section back end portion having a number of spaced back end portion snap end receiving apertures formed therethrough in parallel orientation with an inner guard section back edge; an outer guard section back end portion having a number of spaced back end portion snap ends extending outwardly therefrom sized and spaced to simultaneously snap fit into the number of back end portion snap end receiving apertures of the inner guard section; the inner guard section front end portion having a number of spaced front end portion snap end receiving apertures formed therethrough in parallel orientation with the inner guard section back edge and four tip end snap end receiving apertures formed therethrough in a square shaped configuration positioned between the spaced front end portion snap end receiving apertures and the inner guard section front end edge; the outer guard section front end portion having a number of spaced front end portion snap ends extending outwardly therefrom in parallel orientation with the outer guard section back end edge and sized and spaced to simultaneously snap fit into the number of front end portion snap end receiving apertures of the inner guard section and four tip end snap ends extending outwardly therefrom in a square shaped configuration positioned between the spaced front end portion snap ends and the outer guard section front end edge.

It is noted that the embodiment of the buckle guard described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A buckle guard comprising:

a back guard section;

an inner snap guard section; and an outer snap guard section;

said back guard section being integrally formed between said inner snap guard section and said outer snap guard section;

said back guard section, said inner snap guard section and said outer snap guard section being constructed of a bendable plastic;

said back guard section being bendably connected to said inner snap guard section and said outer snap guard section by two bendable back guard connection portions positioned midway between back guard section front and back end edges and extending out on opposite side edges thereof;

one bendable back guard connection portion being in connection with a bendable inner snap guard connection portion extending outward from a mid section of said inner snap guard section such that a first insertion slot is formed between a front portion of said inner guard section and a first side edge of a front portion of said back guard section;

said other bendable back guard connection portion being in connection with a bendable outer snap guard connection portion extending outward from a mid section of said outer snap guard section such that a second insertion slot is formed between said front portion of said outer guard section and a second side edge of a front portion of said back guard section;

said corner ends of an inner snap guard section front end edge, an outer snap guard section front end edge, and said back guard section front end edge being beveled to create a first enlarged strap insertion guide at art entrance of said first insertion slot and a second enlarged strap insertion guide at an entrance of said second insertion slot to aid in inserting said straps of said seat belt and shoulder harness during installation of said buckle guard;

an inner guard section back end portion having a number of spaced back end portion snap end receiving apertures formed therethrough in parallel orientation with an inner guard section back edge;

an outer guard section back end portion having a number of spaced back end portion snap ends extending outwardly therefrom sized and spaced to simultaneously snap fit into said number of back end portion snap end receiving apertures of said inner guard section;

said inner guard section front end portion having a number of spaced front end portion snap end receiving apertures formed therethrough in parallel orientation with said inner guard section back edge and four tip end snap end receiving apertures formed therethrough in a square shaped configuration positioned between said spaced front end portion snap end receiving apertures and said inner guard section front end edge;

said outer guard section front end portion having a number of spaced front end portion snap ends extending outwardly therefrom in parallel orientation with said outer guard section back end edge and sized and spaced to simultaneously snap fit into said number of front end portion snap end receiving apertures of said inner guard section and four tip end snap ends extending outwardly therefrom in a square shaped configuration positioned between said spaced front end portion snap ends and said outer guard section front end edge.

* * * * *